United States Patent [19]

Hicks et al.

[11] 4,126,309

[45] Nov. 21, 1978

[54] ROTATABLE TARGET GAME DEVICE

[75] Inventors: Alan A. Hicks, Chicago; Jeffrey D. Breslow, Highland Park; Eugene Jaworski, Park Ridge, all of Ill.

[73] Assignee: Marvin Glass & Associates, Chicago, Ill.

[21] Appl. No.: 765,979

[22] Filed: Feb. 7, 1977

[51] Int. Cl.[2] ..... A63F 9/00

[52] U.S. Cl. ..... 273/95 R; 273/102.1 C; 273/105 R; 273/105.2

[58] Field of Search ..... 273/1 R, 85 C, 85 D, 273/85 E, 85 F, 86 A, 93 C, 95 R, 95 B, 98, 100, 102 R, 102 A, 102 AP, 102 AF, 102 PM, 102.1 R, 102.1 C, 102.1 CM, 102.1 D, 102.1 E, 102.1 F, 105 R, 105.2, 106 E, 127 R, 127 D, 138 R

[56] References Cited

U.S. PATENT DOCUMENTS

| | | | |
|---|---|---|---|
| 939,580 | 11/1909 | Young | 273/100 |
| 1,249,716 | 12/1917 | Calder | 273/95 R |
| 1,949,554 | 3/1934 | Winning et al. | 273/102.1 D |
| 3,083,019 | 3/1963 | Giuliano | 273/95 B X |
| 3,208,751 | 9/1965 | Kostka | 273/95 B |
| 3,471,149 | 10/1969 | Glass et al. | 273/1 R |
| 3,582,075 | 6/1971 | Glass et al. | 273/95 R |
| 4,048,731 | 9/1977 | Baguioro | 273/138 R X |

*Primary Examiner*—William H. Grieb
*Attorney, Agent, or Firm*—Mason, Kolehmainen, Rathburn & Wyss

[57] ABSTRACT

An amusement game device includes a rotatable playing surface which is provided with a number of target points and corresponding numerical indicia. A target aiming tower is provided for each game player through which playing objects are dropped by each game player. A set of playing cards bearing numerical indicia correspond to and identify the various target points on the rotatable playing surface. The target points are formed by openings in the surface of the rotatable playing surface which are aligned with respective underlying biased target arm members. When a target arm member is contacted by a playing object, a symbol indicating a hit or score is aligned with a respective opening so as to be visible to the game players.

12 Claims, 5 Drawing Figures

ROTATABLE TARGET GAME DEVICE

BACKGROUND OF THE INVENTION

This invention relates to an amusement game device that is also a skill type game design for the entertainment of the player and for developing dexterity and coordination of the individual players as well as competition between a number of players. The invention relates more particularly to a rotatable playing surface wherein playing objects are released from and through a target aiming tower and aimed to contact various target points.

There are various surface projectile type games which conventionally include a playing surface over which balls or other playing objects are propelled towards various targets disposed at selective positions on or about the playing surface. Other entertaining dexterity developing games are also known such as dropping clothespins in a bottle or the like wherein a player aims a clothespin from an elevated point above a container with the object of dropping the clothespin into the bottle.

There is a constant need for new and improved games of the general character described which are readily understood by most individuals, particularly children, which are interesting to children, which are of a competitive nature, and involve skill producing concepts such as aiming, manual dexterity and eye-hand coordination.

SUMMARY OF THE INVENTION

The present invention provides a new and improved amusement game device and includes a rotatable playing surface with defined target points formed by circular openings in a rotatable playing surface and movable target arm members which align a hit symbol when contacted by playing objects dropped by one of the game players from a height. Positionable target aiming towers or bomb sight towers are provided through which a game player aims and releases a playing object to contact a desired target point on the rotatable playing surface. A deck of playing cards is also provided bearing numerical indicia which define corresponding target points. One of the cards is exposed and the game players proceed to aim the playing objects. After one of the game players hits or scores the target point corresponding to the exposed card, the game player scores a numer of points corresponding to the numerical indicia or in accordance with other scoring arrangements. Another card is turned over and the game players proceed to attempt to hit the target point corresponding to the subsequently turned over card.

DESCRIPTION OF THE PREFERRED EMBODIMENT

Figures 1, 2, 3, 4, 5:
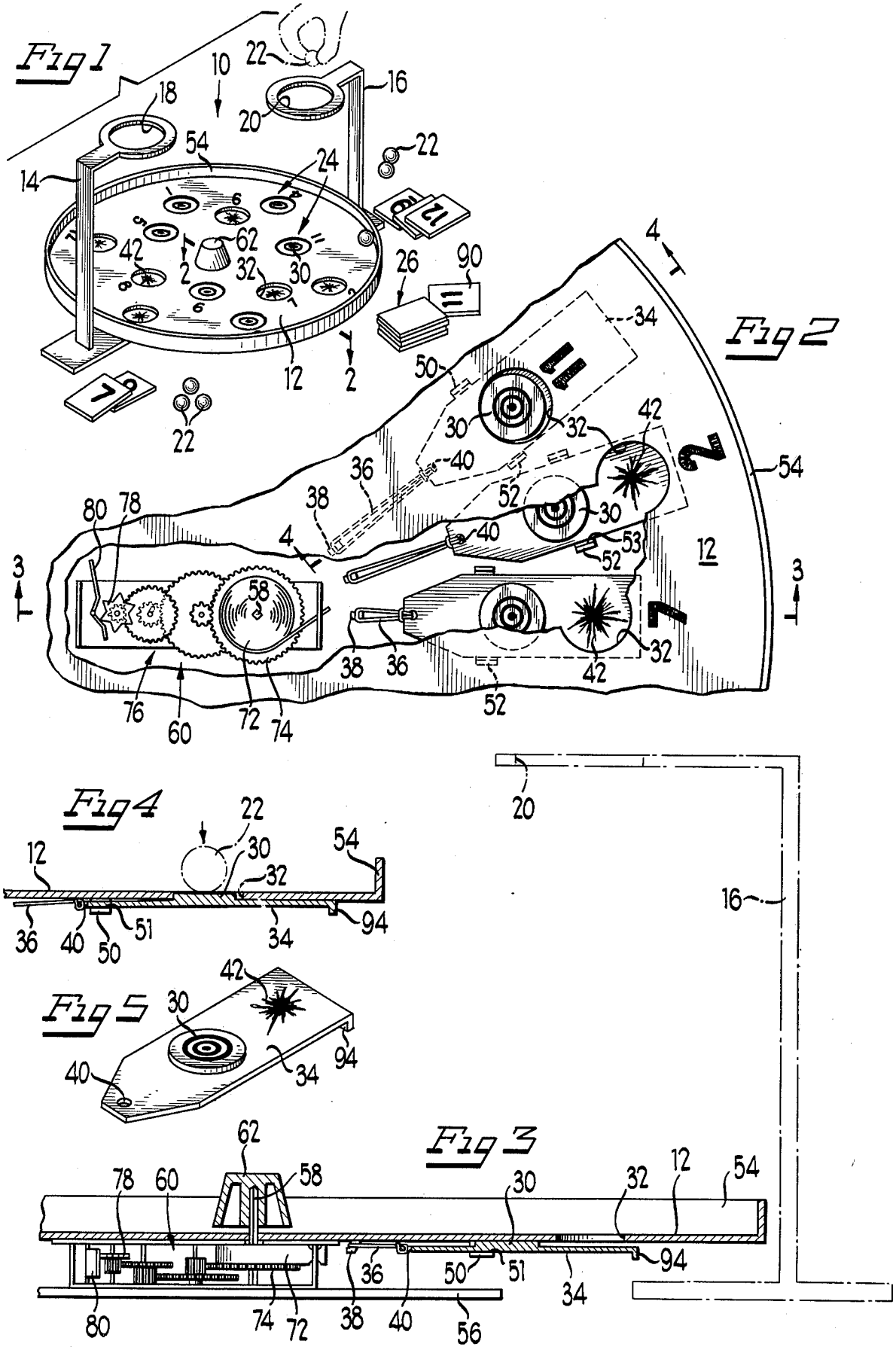
FIG. 1 is a perspective view of the amusement game device of the present invention.
FIG. 2 is a fragmentary elevational view on an enlarged scale with parts broken away taken generally along the line 2—2 of FIG. 1.
FIG. 3 is a vertical sectional view taken along the line 3—3 of FIG. 2.
FIG. 4 is a vertical sectional view taken along the line 4—4 of FIG. 2.
FIG. 5 is a perspective view of a movable target arm member of the amusement game device of FIGS. 1 and 2.

The amusement game device of the present invention, referring to FIG. 1, is generally designated 10 and includes a rotatable playing surface 12 and a number of upstanding target aiming tower members 14, 16 having generally circular defined openings or sights 18, 20 through which playing objects or balls 22 are dropped by a game player to contact defined target points generally designated 24 on the rotatable playing surface 12. The target points 24 correspond to and are identified by numerical indicia on playing cards such as the deck of playing cards 26 which are provided with the game amusement device 10. In a specific embodiment, the target aiming towers 14, 16 resemble and correspond to bombing towers or bomb sights.

The target points 24 are defined by the extension of a circular shaped protruding target tab or raised portion 30 formed on a displaceable target arm member 34 through a circular shaped target opening or ring 32 in the rotatable playing surface 12 having a somewhat larger diameter than the target tab 30. The target arm member 34 is biased or urged toward the center of the rotatable playing surface 12. The displaceable target arm member 34 is retained in a first position when the circular target tab 30 projects through the corresponding target opening 32 by the engagement of the raised sidewall of the target tab 30 with the edgewall formed by the target opening 32. The displaceable target arm member 34 is biased or urged toward a second central position by an elastic band 36 or other suitable urging element which is connected between a downwardly extending prong 38 formed on the bottom surface of the rotatable playing surface 12 and fastened around the target arm 34 through a hole 40.

The target arm 34 is urged or displaced to its central inner position when the target tab 30 is displaced downwardly sufficiently to disengage the sidewall of the target tab 30 from the edgewall of the rotatable playing surface 12 formed around the passage 32. The displacement from the first outer target ready position of the target arm 34 to a second inner target hit or target actuated position is accomplished when a playing object 22, referring to FIG. 4, drops vertically onto the target tab 30 displacing the target arm 34 downwardly to disengage the target tab 30 from the edgewall of the rotatable playing surface 12. In the second inner target actuated or target hit position of the target arm 34, a target hit symbol 42 is aligned with the circular target opening 32 to display that the particular target point 24 has been contacted or hit.

The displacement path of the target arm 34 is partly determined by the relative orientation of the extending prong 38 with respect to the target arm 34 and further by the engagement of the side edges of the target arm 34 in a pair of guide channels 50, 52. The guide channels 50, 52 are formed in molded surfaces 51, 53 extending from the bottom of the playing surface 12 and support the target arm 34. Numerical indicia, for example the numeral 11, is formed on the rotatable playing surface 12 adjacent the associated circular target opening 32 so as to be substantially radially aligned therewith through the center of the rotatable playing surface 12. The associated numerical indicia is utilized in one scheme of play to identify a particular target point 24 and distinguish it from the other plurality of target points located at various radial positions around the playing surface 12. The numerical indicia may also be utilized to assign a point score which a game player accumulates to his total score when he actuates or hits the particular target 24 associated with the corresponding numerical indicia.

The rotatable playing surface 12 includes an upstanding edgewall 54 about the circumference of the surface 12 to retain dropped playing objects 22 within the confines of the playing surface 12. The playing surface 12 is rotatably supported upon a central base member 56 through a square output shaft 58 extending from a drive means device 60 supported on the base member 56. A central knob 62 is provided at the center of the rotatable playing surface 12 and includes a central axial journal for engagement with the square output shaft 58.

The drive means device 60 includes a spirally wound coil spring 72 which is fixed to one gear 74 of a gear train generally designated 76 which is in mesh with a star wheel 78. The rotation of the star wheel 78 is limited or governed by an engaging oscillating governor leaf 80. The square output shaft 58 is fixed for rotation with the gear 74 and the coil spring 72 and thus drives the rotatable playing surface 12.

To start the play of the game, one of the game players winds the drive means device 60 by rotation of the knob 62 a suitable number of revolutions. When the knob 62 is released, or in a specific embodiment when the drive means 60 is actuated, the playing surface 12 rotates at a predetermined speed whereupon the various targets 24 pass by and near the game players' observation or playing stations disposed around the playing surface 12.

In one scheme of play contemplated by the present invention, each game player is positioned at a different circumferential position about the playing surface 12 so as to generally define a playing station by the position of the associated target aiming tower 14, 16. As the number of game players increases, it may be desirable in various schemes of play to limit the movement of each target aiming tower by the associated game player. In one specific scheme of play, it is contemplated that the target aiming towers such as 14, 16 will be movable only in a radial direction relative to the center of the rotatable playing surface 12.

In any event the rotatable playing surface 12 is set into rotation by means of the drive means device 60 and each player is provided with a number of playing objects 22 which in a specific embodiment are balls or marbles. In one particular scheme of play, a predetermined number of playing objects may be provided to each game player to allow a skillful game player to accumulate a higher point score and to increase the competitive nature of the game.

In accordance with one scheme of play, the table surface 12 rotates at a predetermined speed according to the drive gear means 60 and one of the cards 90, for example, bearing the numerical indicia numeral 11, is turned face up from the pile of cards 26. The game players proceed to drop playing objects 22 attempting to hit the target 24 corresponding to the numeral 11 as it passes the general area of the playing position of each of the players. The players drop the playing objects 22 through the generally circular openings or sights such as 18 of the target aiming tower platform 14.

The interest of the game including the competitiveness and the skill required to hit a particular target is greatly enhanced in accordance with the features of the present invention due to the rotation of the playing surface 12. Thus, the game player is attempting to time the dropping of the playing object or ball 22 to hit a particular moving target 24 of a number of target points which are disposed at various positions both radially and circumferentially about the playing surface 12. Accordingly, the target aiming towers 14, 16 must be moved in at least a radial direction by each game player in order to align the aiming sight 18 or 20 with the various targets 24 further enhancing the competitiveness and skill required to play the game.

After one of the game players has succeeded in dropping one of his playing objects 22 to contact the target tab 30 of the target 24 corresponding to the overturned card such as 90, that player takes the card 90 and adds it to his pile of hits or target scores and accumulates the point score indicated either by the target numeral such as 11 on the card 90 or by other arrangements.

The play continues by turning over another card from the pile 26 that identifies another corresponding target point on the game playing surface 12 wherein the game players proceed to drop playing objects to contact the associated target tab 30 in attempting to score the particular target. The play continues in this manner until either the players have utilized a predetermined number of playing objects 22 or the pile of cards 26 has been exhausted. As various game players hit the target points with the playing objects, the target indicates a score by the positioning of the hit symbol 42 within the associated target ring 32. Once a target 24 has been contacted and scored with the displaceable target arm 34 moving to the inward scored position displaying the symbol 42, the target remains scored and out of play for the remaining part of the game.

When one round of play or the game has been completed as determined as discussed hereinabove, the amusement device 10 is readied for another round or game by repositioning the target arms 34 to their outward positions with the target tab 30 protruding into the target opening 32. A downwardly extending edge 94 is provided on the outward most portion of the target arm 34 to allow a game player to grasp the target arm 34 by the edge 94 to retract the arm 34 to the outward position. With all the targets 24 positioned to their unactuated or play positions, the amusement game device is ready for play. The various playing objects 22 that have been dropped onto the playing surface 12 during the previous play are also removed and distributed to the game players. The playing objects in various specific embodiments and schemes of play may be termed bombs and formed in the general shape of a bomb or other projectile such as a bullet.

Of course, it is also contemplated that the play of the game be varied, for example, by having the game players each attempting to score different targets or by playing the game without the use of the cards 26. In that event, various targets 24 may be assigned to the particular game player and the opposing game players attempt to actuate or hit all the targets assigned to the other game player whereupon a particular game player may be considered to be out of the game.

It should also be understood that in alternative embodiments the playing surface 12 instead of rotating may be movable in a vibratory, linearly reciprocative, irregular, non-linear or other path or combination of paths. The drive source of such arrangements may include vibratory sources, irregularly shaped cam drives or various other conventional drive mechanisms.

The foregoing detailed description has been given for clearance of understanding only and no unnecessary limitations should be understood therefrom, as some modifications will be obvious to those skilled in the art.

What is claimed is:

1. An amusement apparatus, comprising:

a frame;

a playing surface mounted on said frame for movement with respect thereto;

at least one target means disposed on and carried by said movable playing surface;

at least one projectile which is released from a predetermined elevated position for movement toward said playing surface under the influence of gravity; and aiming means to facilitate directing of said projectile along a path of travel into engagement with said target means, said playing surface having at least one passage formed therethrough, said target means comprising a displaceable member, means for urging said displaceable member from a first position to a second position and means located on said displaceable member for cooperating with said playing surface to retain said displaceable member in said first position, said displaceable member moving from said first position to said second position in response to said urging means when said projectile is released and engages said target means, said displaceable member including indicia aligned with said passage in said second position representing an engaged target means.

2. The amusement apparatus of claim 1 wherein said playing surface is rotatably mounted on said frame.

3. The amusement apparatus of claim 2 including drive means mounted on the frame in driving engagement with said rotatable playing surface to automatically rotate the playing surface relative to the frame.

4. The amusement apparatus of claim 3 wherein said aiming means comprises a generally vertically extending member defining said predetermined elevated position for said projectiles.

5. The amusement apparatus of claim 4 wherein said vertically extending member includes a guide element at the top thereof to facilitate aiming of the projectile in a path of travel toward said target means.

6. The amusement apparatus of claim 5 including a plurality of projectiles and a plurality of target means disposed on the playing surface.

7. The amusement apparatus of claim 6 wherein at least some of said target means are disposed at different radial positions on said playing surface.

8. An amusement game device, comprising:

a movable playing surface;

a base supporting said movable playing surface;

at least one target means disposed on and carried by said movable playing surface; and at least one playing object which is dropped from a predetermined elevated position to contact said target means, said target means comprising a displaceable member, means for urging said displaceable member from a first position to a second position and means located on said displaceable member for cooperating with said movable playing surface to retain said displaceable member in said first position, said displaceable member moving from said first position to said second position in response to said urging means when said playing object is dropped and contacts said target means, said cooperating means of said target means comprising a protuberance extending from said displaceable member which is contacted by said playing object and said playing surface has at least one passage formed therethrough adapted to interfit with said displaceable member protuberance, said passage being of the same general shape as the displaceable member protuberance and of slightly larger dimensions to allow said protuberance to be aligned within the passage, said displaceable member including indicia aligned with said passage in said second position representing a contacted target means.

9. An amusement game device comprising:

a movable playing surface;

a base supporting said movable playing surface;

at least one target means disposed on and carried by said movable playing surface; and at least one playing object which is dropped from a predetermined elevated position to contact said target means;

said target means comprising a displaceable member, means for urging said displaceable member from a first position to a second position and means located on said displaceable member for cooperating with said movable playing surface to retain said displaceable member in said first position, said displaceable member moving from said first position to said second position in response to said urging means when said playing object is dropped and contacts said target means, said cooperating means of said target means comprising a protuberance extending from said displaceable member which is contacted by said playing object, said playing surface having at least one passage formed therethrough adapted to interfit with said displaceable member protuberance, said passage being of the same general shape as the displaceable member protuberance and of slightly larger dimensions to allow said protuberance to be aligned within the passage, said displaceable member in said first and second positions and during movement from said first to second positions being disposed generally parallel to the plane of said playing surface.

10. The amusement game device of claim 9 wherein said displaceable member includes indicia aligned with said passage in said second position representing a contacted target.

11. The amusement game device of claim 10 wherein said passage is generally circular.

12. The amusement game device of claim 10 wherein said displaceable member protuberance includes target ring indicia thereon visible from the top of said playing surface through said passage.

* * * * *